US009086659B2

(12) United States Patent
Suzuki

(10) Patent No.: US 9,086,659 B2
(45) Date of Patent: Jul. 21, 2015

(54) IMAGE FORMING APPARATUS

(75) Inventor: Shinya Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 13/613,773

(22) Filed: Sep. 13, 2012

(65) Prior Publication Data

US 2013/0101321 A1 Apr. 25, 2013

(30) Foreign Application Priority Data

Oct. 19, 2011 (JP) ..... 2011-229602

(51) Int. Cl.
*G03G 15/16* (2006.01)
*G03G 15/00* (2006.01)

(52) U.S. Cl.
CPC ..... *G03G 15/1615* (2013.01); *G03G 15/755* (2013.01); *G03G 2215/00143* (2013.01); *G03G 2215/00151* (2013.01); *G03G 2215/00156* (2013.01); *G03G 2215/0129* (2013.01)

(58) Field of Classification Search
CPC ..... G03G 15/1615; G03G 15/755; G03G 2215/0129; G03G 2215/00151; G03G 2215/00156; G03G 2215/00143
USPC ..... 399/302, 394, 395, 51; 271/227, 228, 271/236, 248, 17, 15, 13, 253, 254
See application file for complete search history.

(56) References Cited

U.S. PATENT DOCUMENTS

| | | | | |
|---|---|---|---|---|
| 5,053,815 | A * | 10/1991 | Wendell | 399/10 |
| 6,385,426 | B1 | 5/2002 | Kimura et al. | |
| 6,415,130 | B1 | 7/2002 | Fujiwara et al. | |
| 6,438,333 | B1 | 8/2002 | Katsumi et al. | |
| 8,023,873 | B2 | 9/2011 | Nakatsu | |
| 2008/0056790 | A1* | 3/2008 | Maruyama | 399/395 |
| 2008/0240802 | A1* | 10/2008 | Nakura | 399/313 |
| 2008/0279572 | A1 | 11/2008 | Nakatsu | |
| 2009/0180805 | A1* | 7/2009 | Nakura et al. | 399/165 |
| 2011/0243618 | A1* | 10/2011 | Nakamura | 399/308 |

FOREIGN PATENT DOCUMENTS

| | | | |
|---|---|---|---|
| JP | 3-288167 | A | 12/1991 |
| JP | 6-118823 | A | 4/1994 |
| JP | 2750939 | B2 | 5/1998 |
| JP | 11-072980 | A | 3/1999 |
| JP | 2003-330300 | A | 11/2003 |
| JP | 2004-226660 | A | 8/2004 |
| JP | 3744141 | B2 | 2/2006 |
| JP | 2008083249 | A * | 4/2008 |
| JP | 2008-281833 | A | 11/2008 |
| JP | 2008-298958 | A | 12/2008 |

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

In an apparatus which controls the bias of an intermediate transfer belt, the position shift of the width direction between a toner image and a recording material is reduced. Based on the results of estimating the variation moving in the width direction of the intermediate transfer belt, the position in the width direction of the recording material conveyed to a transfer position is changed to match the positions in the width direction of the toner image and the recording material.

4 Claims, 10 Drawing Sheets

IMAGE FORMING APPARATUS

BACKGROUND OF THE INVENTION

1. Field of the Invention

The present invention relates to an image forming apparatus using an electrophotographic method such as a copying machine, and particularly to an image forming apparatus of the intermediate transfer method in which an endless intermediate transfer belt is provided and toner images formed on the intermediate transfer belt are transferred onto a recording material to obtain output images.

2. Description of the Related Art

Conventionally, a number of image forming apparatuses of the intermediate transfer method, in which toner images with different colors formed on a photoreceptor are primarily transferred in a sequentially superimposed manner onto the endless intermediate transfer belt, and the toner images formed on the intermediate transfer belt are secondarily transferred onto a recording material, have been proposed.

In such an image forming apparatus, such as in Japanese Patent Laid-Open No. 3-288167, deviation or skew is apt to occur on the belt while the intermediate transfer belt is driven and it is necessary to prevent damage to the belt by biasing, etc. As a unit for controlling the bias of the belt, a technology in which the belt bias condition is detected by a detection unit installed around the belt and a biasing force is given to the belt by force so that the belt makes reciprocal movement reliably within a given range has been proposed.

Japanese Patent Laid-Open Nos. 2003-330300 and 6-118823 also use technology in which the central portion of a support member of a roller holding a belt has a crown shape formed with a large diameter and the belt is made to follow the shape of the roller to generate internal stress difference between the end portion and the central portion of the belt, so that the belt is deviated toward the center.

Nevertheless, if the deviation control of the endless belt as described in the above-mentioned patent documents is applied to the intermediate transfer belt mentioned above, there is a possibility of the following problems occurring. That is, if the intermediate transfer belt is moved by the deviation control in the width direction that is perpendicular to the running direction, the positions of the toner image and the recording material may deviate in a width direction until the toner image formed on the photoreceptor is transferred onto the recording material through the intermediate transfer belt.

As a result, there is a possibility of a problem in which the widths of the left and right margins of the printed material are different. In the case of outputting duplex printed material in which images are formed on both sides of the recording material, there is a possibility of another problem in which a good duplex printed material cannot be output because the image position of the obverse and the image position of the reverse do not match due to the different widths of the left and right margins on the obverse and the reverse.

SUMMARY OF THE INVENTION

The present invention provides an image forming apparatus including a movable photoreceptor, a charging device which charges the photoreceptor, an exposure device which forms an electrostatic latent image by exposing the charged photoreceptor to form an electrostatic latent image, a developing device which develops the electrostatic latent image formed on the photoreceptor to form a toner image, an endless intermediate transfer belt on which the toner image on the photoreceptor is transferred, a driving portion which drives and runs the intermediate transfer belt, a transfer device which transfers the toner image on the intermediate transfer belt to a recording material at a transfer portion, a control mechanism which controls a bias position of the width direction crossing to the running direction of the intermediate transfer belt, position detection sensor which detect the position in the width direction of the intermediate transfer belt, a recording material supplying device which supplies the recording material to the transfer portion and can change the position in the width direction of the recording material, and a controller which sets the position in the width direction of the recording material supplied to the transfer portion by the recording material supplying device so that the relative position of the width direction of the toner image on the intermediate transfer belt and the recording material in the transfer portion are within a predetermined range based on the detection results of the position detection sensor.

According to the present invention, it is possible to reduce the position shift of the width direction between the toner image and the recording material so that the positions of the toner image and the recording material match, because the position in the width direction of the electrostatic latent image or the recording material is controlled.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the accompanying drawings.

First Embodiment

A first embodiment of the present invention will be described using FIGS. 1 to 7. First, a schematic configuration of an image forming apparatus will be described using FIG. 1.

[Image Forming Apparatus]

Figure 1:
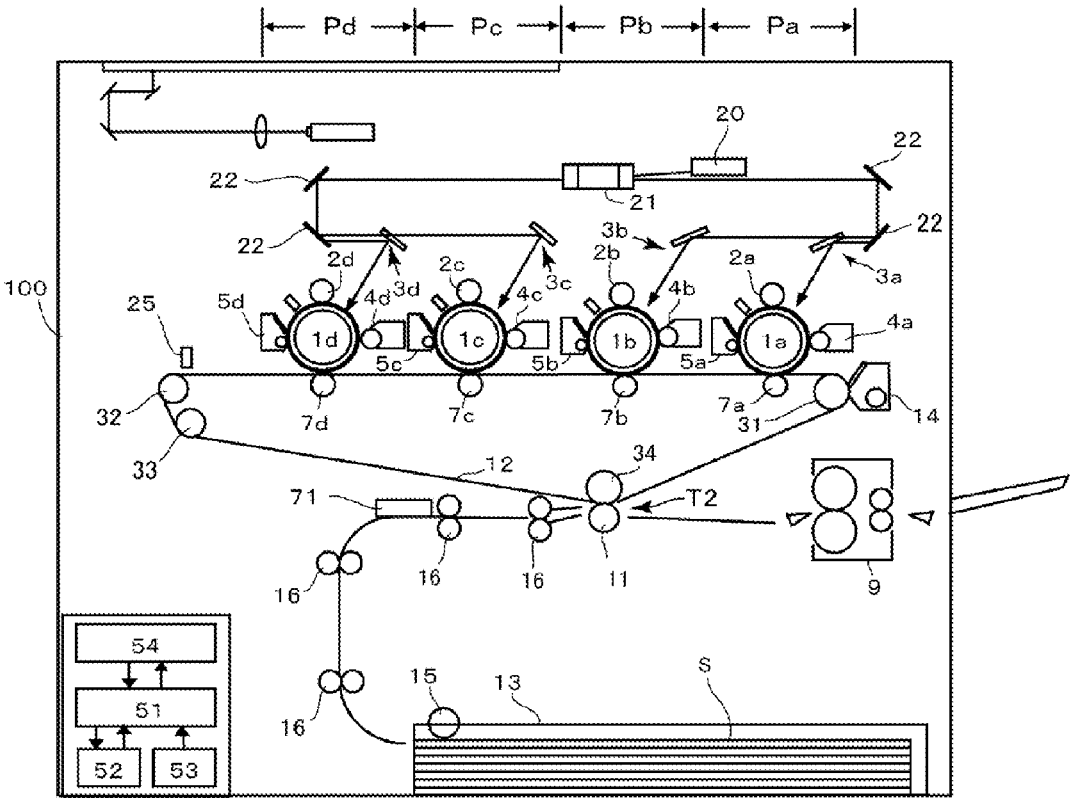
FIG. 1 is a view showing a schematic configuration of an image forming apparatus according to a first embodiment of the present invention.

FIG. 1 shows a color image forming apparatus of a tandem-type intermediate transfer method of the present embodiment. In the image forming apparatus of the present embodiment, four image forming stations (image forming portions) Pa, Pb, Pc and Pd are deposited side by side in the running direction (image transmission direction) of an endless intermediate transfer belt 12. Since the configurations of the image forming stations are almost identical except that the colors of toners are different, the same content will be described by omitting (and adding as necessary) the attached letters showing the configuration of that image forming station.

The image forming station P includes a photosensitive drum 1, which is an image bearing member, a charging device 2, an exposure device 3, which is an electrostatic latent image forming unit, a developing device 4, which is a developing unit, a cleaning device 5 and a primary transfer device 7. An intermediate transfer belt 12, which is an intermediate transfer member, is movably disposed so as to move between the photosensitive drums 1*a* to 1*d* and the primary transfer devices 7*a* to 7*d* of the image forming stations Pa to Pd.

The photosensitive drum 1 is rotated by a driving unit that is not shown and has the surface charged to a predetermined potential by the charging device 2. In addition, the surface of the charged photosensitive drum 1 is exposed by the exposure device 3 based on the image signals input from a scanner or external terminal and an electrostatic latent image is formed on this surface. The electrostatic latent image formed on the photosensitive drum 1 is developed by the developing device 4 into a toner image of each color.

The exposure device 3 has a light source device 20, a polygonal mirror 21, reflecting mirrors 22, and a lens fθ or the like. The laser beam emitted from the light source device 20 is radiated by rotating the polygonal mirror 21, and the beam bundle of the radiated beam is deflected by a plurality of reflecting mirrors 22 and collected on the generating line of the photosensitive drum 1 by the lens fθ, so that exposure is performed, thereby forming an electrostatic latent image on the photosensitive drum 1 depending on the image signals.

In the developing devices 4*a*, 4*b*, 4*c* and 4*d*, a predetermined quantity of developer, in which non-magnetic toners of yellow, magenta, cyan and black and magnetic carriers are mixed at a predetermined mixing quantity, is filled. The electrostatic latent image on the photosensitive drum is developed by toners of the respective colors.

The respective toner images of the respective colors formed on the respective photosensitive drums 1*a*, 1*b*, 1*c* and 1*d* are sequentially superimposed on the intermediate transfer belt 12 by the respective primary transfer devices 7*a*, 7*b*, 7*c* and 7*d* to be primarily transferred, thereby forming a full-color toner image on the intermediate transfer belt.

Meanwhile, the recording material S accommodated in a recording material cassette 13 is conveyed by a pickup roller 15 and a plurality of conveying rollers 16 to a secondary transfer device 11, which is a transfer unit. The toner image carried on the intermediate transfer belt 12 is transferred secondarily onto the recording material S. The recording material S with the transferred toner image is discharged from the device as a recorded image after the toner image is fixed in a fixing device 9 by heating and pressing.

In addition, downstream in the running direction of the intermediate transfer belt from a secondary transfer position T2 to the recording material S, the fog toner attached to the surface of the intermediate transfer belt 12 or the secondary transfer residual toner is cleaned in constant contact with an intermediate transfer belt cleaning blade 14. Meanwhile, the primary transfer residual toner remaining on the photosensitive drum 1 is cleaned by a cleaning device 5 such as a fur brush or a blade.

Further, an image forming apparatus body 100 has a controller 51, which is a unit for controlling the body. A RAM 52, which is used as a memory for operating, a ROM 53, in which programs performed by the controller and various data are stored, and a backup RAM 54, which backs up the obtained data or the like, are connected to the controller 51. Each portion is controlled by the controller 51 as mentioned above to form images.

[Intermediate Transfer Belt Unit]

Figure 2:
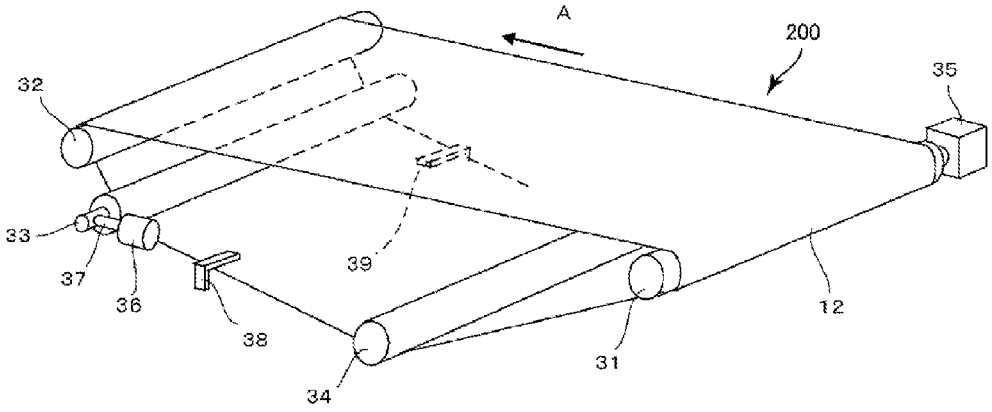
FIG. 2 is a perspective view showing a schematic configuration of an intermediate transfer belt unit.

Next, using FIG. 2, an intermediate transfer belt unit 200 which drives the intermediate transfer belt 12 and controls the bias of the intermediate transfer belt will be described. The intermediate transfer belt 12 is tightly stretched by an immovably installed driving roller 31, a tension roller 32, a steering roller 33, and four secondary transfer inner rollers 34. The intermediate transfer belt 12 is run in the arrow A direction by a driving motor 35, which is a driving unit installed on the driving roller 31.

The steering roller 33 is connected to a rod 37 which has a rotating axis connected coaxially to an actuating axis of an actuator 36 such as a stepping motor. The actuating axis of the actuator 36 makes reciprocating motion to change (rock) the axis gradient of the steering roller 33 so as to control the bias of the intermediate transfer belt 12. Meanwhile, when the stepping motor is used as the actuator 36, the variation of the steering roller 33 can be set by the number of drive pulses output for the stepping motor. Further, the configuration may be such that a cam is contacted as a rocking unit to the rotating axis or a bush of the steering roller 33 to change the phase of the cam so as to change the axis gradient of the steering roller. In this case, the cam may be driven with the stepping motor.

Further, edge detection sensors 38 and 39, which are position detection units, are disposed at both end portions in the width direction crossing (perpendicular) to the running direction of the intermediate transfer belt 12, between the steering roller 33 and the secondary transfer inner roller 34. With the image forming apparatus body 100 installed, the edge detection sensor 38 is disposed on the front and the edge detection sensor 39 on the back. These edge detection sensors 38 and 39 are disposed each other with, for example, a distance 1 mm longer than the width of the intermediate transfer belt 12. When the edge of the width direction of the intermediate transfer belt 12 is detected by one edge detection sensor, the intermediate transfer belt 12 is controlled by the rocking unit so that it is biased in the direction opposite to the detected side. That is, the intermediate transfer belt 12 has the operation controlled with the width of 1 mm so as to make reciprocating motion (so as to have the bias controlled).

[Bias Control]

Figure 3:
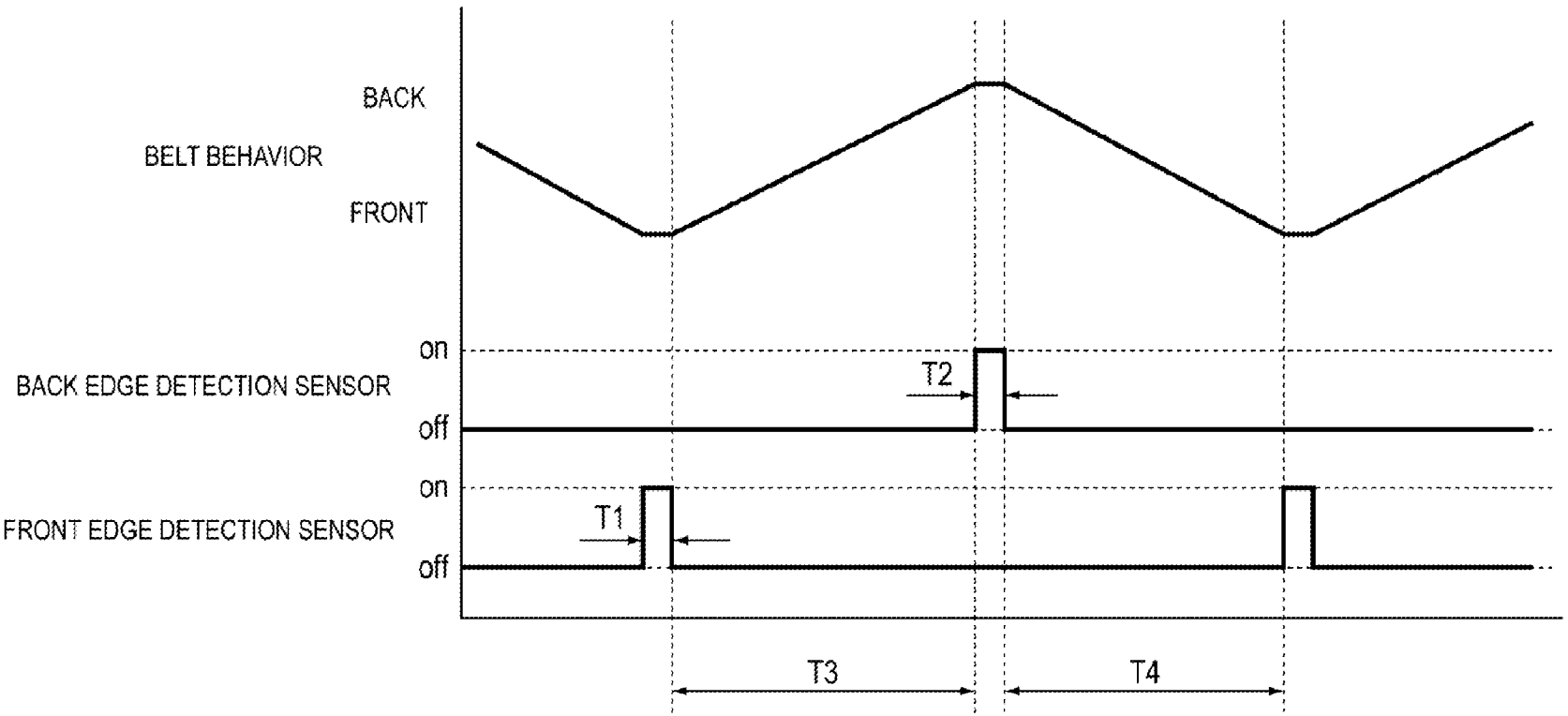
FIG. 3 is a view showing the relation of behavior of the intermediate transfer belt and signals detected by front and back edge detection sensors.

Next, the bias control of the intermediate transfer belt will be described using FIG. 3. When the intermediate transfer belt 12 is biased on the front, it is detected by the front edge detection sensor 38, so that it operates to be biased toward the back by the control of the axis gradient of the steering roller 33. At this time, the bias direction of the intermediate transfer belt 12 is not immediately changed but remains biased toward the front for retention time T1 detected by the front edge detection sensor 38. Next, the intermediate transfer belt 12 goes toward the back and after time T3 the belt is detected by the back edge detection sensor 39, and the belt starts to bias toward the front after retention time T2. Again after time T4, the edge of the intermediate transfer belt 12 is detected by the front edge detection sensor 38.

The front retention time T1, the back retention time T2, the front-to-back-traveling time T3, and the back-to-front-traveling time T4 are stored in the backup RAM 54 provided in the image forming apparatus body 100. The bias control of the intermediate transfer belt 12 and the image forming operation are generally controlled by the controller 51 based on the control program.

As mentioned above, if such a bias of the intermediate transfer belt 12 is controlled, the position in the width direction is shifted with respect to the recording material until the toner image formed at the respective image forming stations P is conveyed to the secondary transfer device 11 through the intermediate transfer belt 12. Thus, the widths of the left and right margins of the printed material become different.

For example, in the case of forming the image of printed material with the widths of the left and right margins of the printed material set at 2.5 mm, it will be assumed that the center position of the recording material shifts Z [mm] to the right with respect to the position on the toner primarily transferred to the intermediate transfer belt. Then, the right margin becomes 2.5+Z [mm] and the left margin becomes 2.5−Z [mm], and the widths of the left and right margins of the output printed material become different by 2Z [mm]. The feature quantity for feeling the difference of the left and right margins was checked with respect to the shift quantity Z to find that if Z is 100 [μm] or less, the difference in the width of the left and right margins was not noticeable in most cases and regarded as a good printed material, but if Z was 300 [μm] or more, the difference in the width of the left and right margins was noticeable in many cases.

By considering the width direction variation of the intermediate transfer belt 12 by bias control, at least any one of the position in the width direction of the electrostatic latent image and the position in the width direction of the recording material should be controlled. In the present embodiment, the position in the width direction of the recording material is adjusted. That is, the width direction variation of the intermediate transfer belt 12 is estimated based on the detection results of the edge detection sensors 38 and 39. What is estimated here is the width direction variation of the intermediate transfer belt 12, from a predetermined latent image forming timing by the exposure device 3 to the time at which the toner image formed on the photosensitive drum 1 is transferred at this timing from the secondary transfer position T2 to the recording material S through the intermediate transfer belt 12. Further, the position in the width direction of the recording material S is controlled so that the position in the width direction of the toner image formed on the photosensitive drum 1 at a predetermined latent image forming timing matches that of the recording material S at a predetermined position.

In the present embodiment, a predetermined latent image forming timing is the timing at which the electrostatic latent image is formed at the image forming station Pa positioned farthest upstream in the running direction of the intermediate transfer belt in a plurality of image forming stations. In addition, a predetermined position is, for example, the position at which the widths of the left and right margins become a predetermined length, and the position at which the widths of the left and right margins become equal, and further the widths of the left and right margins on the printed material become 0. The position in the width direction of the recording material S is adjusted by an adjusting mechanism 70 to be described later.

[Adjusting Mechanism]

Figure 4:
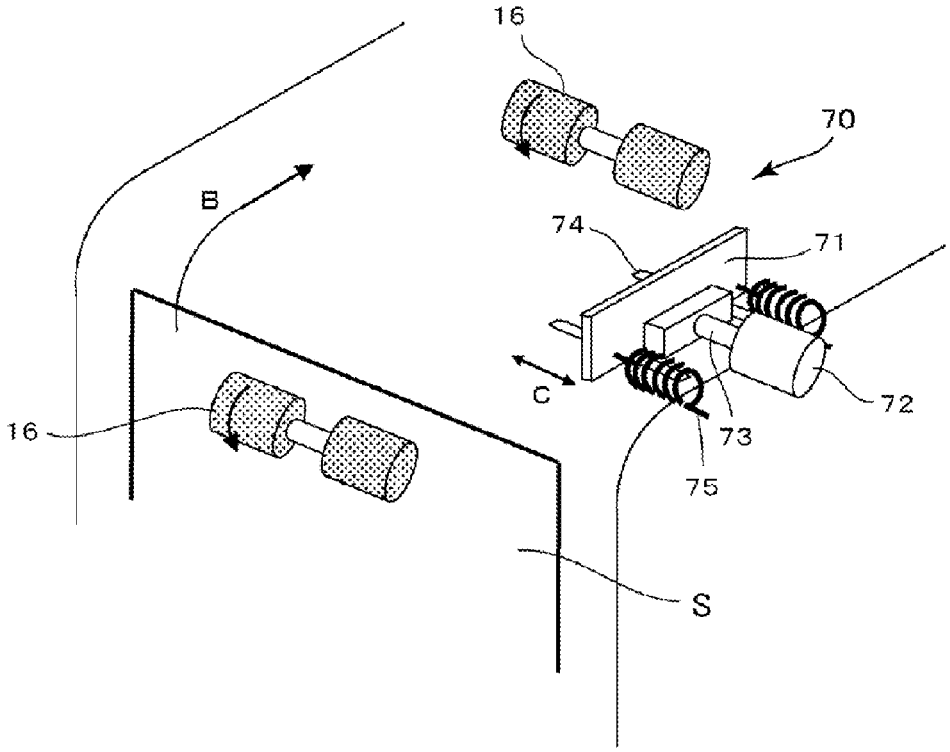
FIG. 4 is a perspective view showing a schematic configuration of an adjusting mechanism disposed in conveying path of the recording material to adjust a position in the width direction of the recording material.

First, the adjusting mechanism 70, which is a unit for adjusting the position in the width direction of the recording material conveyed to the secondary transfer device 11, will be described using FIGS. 4 to 6. As shown in FIG. 4, in the recording material conveying path from the recording material cassette 13 to the secondary transfer device 11, the adjusting mechanism 70 which adjusts the position in the width direction of the recording material is disposed. The adjusting mechanism 70 has a position regulating board 71, an actuator 72, a rail 74 and springs 75. The position regulating board 71 is disposed in parallel with the conveying direction B of the recording material S. The actuator 72 includes a stepping motor, for example, pushing and pulling a rod 73 connected to the position regulating board 71. The rail 74 is disposed in the width direction C crossing (perpendicular) to the conveying direction B so as to guide the position regulating board 71. The springs 75 are pressed in the direction in which the position regulating board 71 is pushed by the actuator 72 and the reverse direction.

A load, such as from abutting the position regulating board 71, is applied from a conveying roller 16 within the conveying path to the recording material S conveyed from the recording material cassette 13. On the surface opposite to the recording material contact surface of the position regulating board 71, the rod 73 that is in coaxial contact with the actuating shaft of the actuator 72 is connected. In the case of using a stepping motor as the actuator 72, the variation of the position regulating board 71 can be set by the number of drive pulses output for the stepping motor. The rail 74 is provided below the position regulating board 71, which is moved by the actuator 72 in the width direction C on the rail. Further, the springs 75 are mounted on the position regulating board 71 to push or loosen the rod 73 so as to be able to move the position regulating board 71 forward and backward. Accordingly, the position in the width direction of the recording material S is adjusted by the adjusting mechanism 70.

Figure 5:
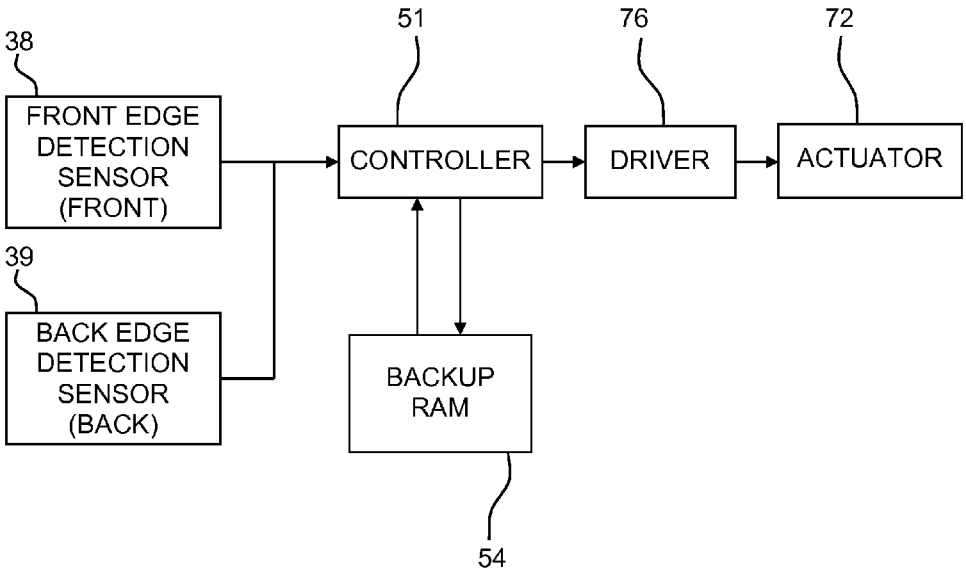
FIG. 5 is a block diagram of a control circuit that controls the adjusting mechanism in the first embodiment.

As shown in FIG. 5, the bias position information of the intermediate transfer belt 12 is sent from the edge detection sensors 38 and 39 on the front and back and history of multiple times is stored in the backup RAM 54. If the image forming job is started and the position of the recording material is to be changed, data is read out from the backup RAM 54, the position variation of the position regulating board 71 is determined by the controller 51, and control command is sent to the driver 76 of the actuator 72. Then, the actuator 72 is actuated to change the position with respect to the width direction C of the position regulating board 71.

Figure 6:
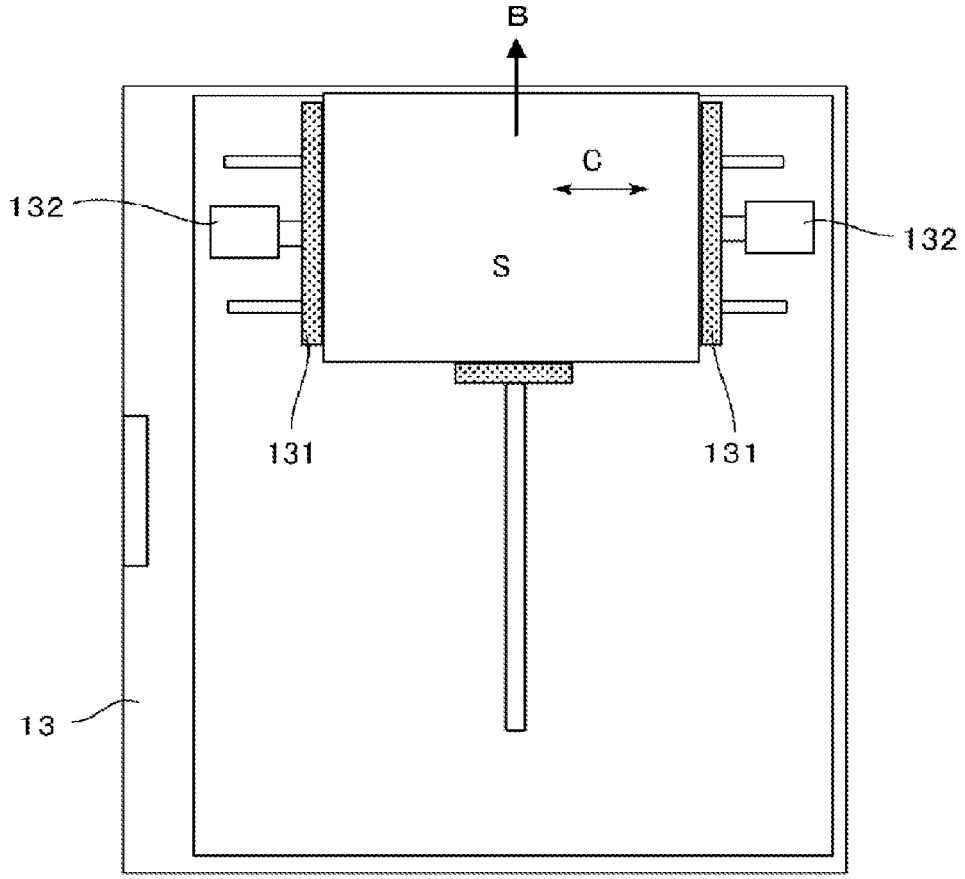
FIG. 6 is a view showing a schematic configuration of another example of the adjusting mechanism.
Figure 7:
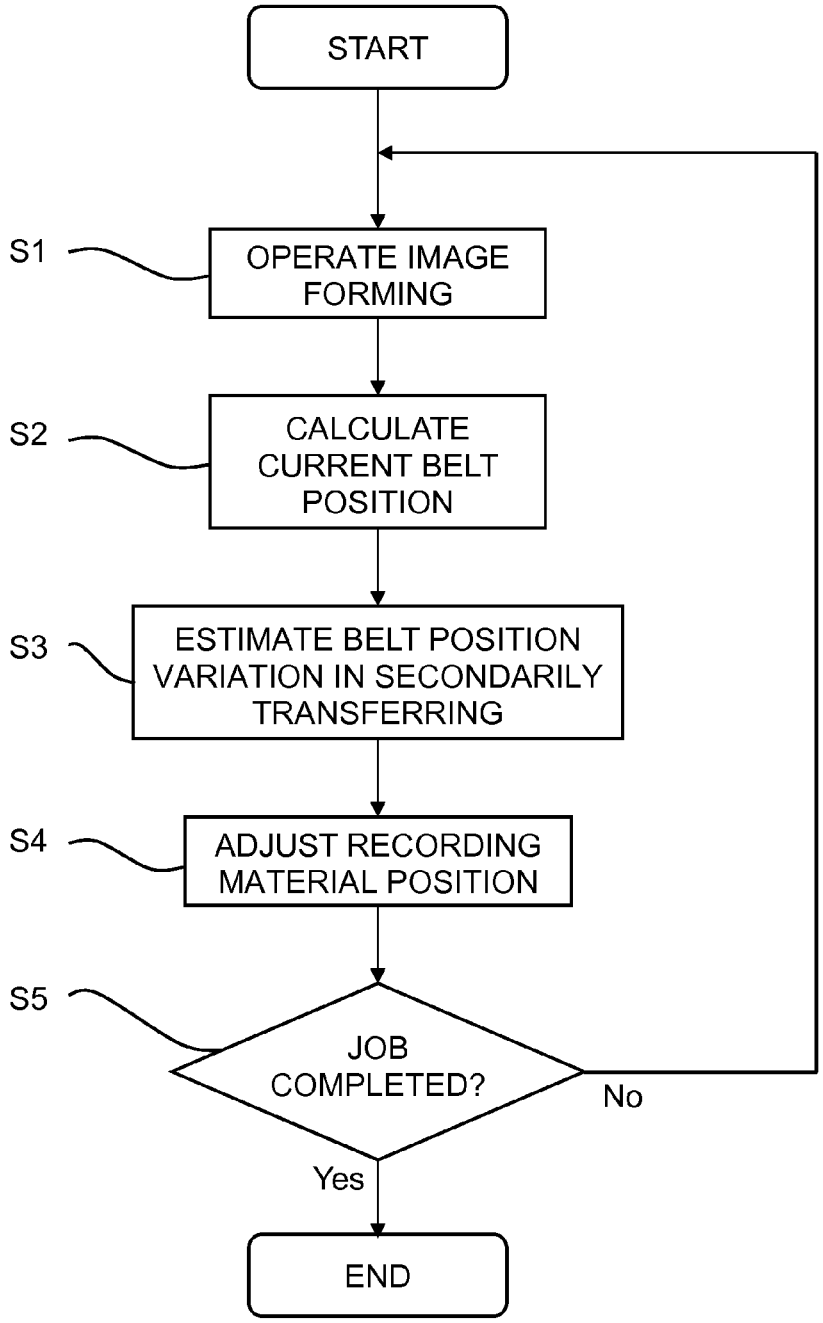
FIG. 7 is a flow chart for controlling the position adjustment of the recording material in the first embodiment.

Meanwhile, the adjusting mechanism is not limited to the configuration mentioned above, and, for example, the configuration as shown in FIG. 6 may be used. In the configuration as shown in FIG. 6, a recording material position regulating board 131 and an actuator 132 are provided in the recording material cassette 13. In this configuration, the actuator 132 is driven and the recording material position regulating board 131 is moved based on the detection results of the edge detection sensors 38 and 39, so that the position of the width direction C perpendicular to the conveying direction B of the recording material S is adjusted.

However, even if the position is adjusted within the recording material cassette 13 like this, there is a possibility of deviation in the width direction occurring in the recording material conveying path while the recording material is conveyed, and thus the position of the recording material may be adjusted at a position near the second transfer position T2. If a plurality of recording material cassettes is provided, a recording material position control unit is necessary for each cassette, and thus the adjusting mechanism may be installed within the conveying path of the recording material in this case as well, as shown in FIG. 4.

[Control Flow]

Next, an example of control flow in which the adjusting mechanism 70 matches the positions in the width direction of the toner image and the recording material S as mentioned above will be described using FIG. 7. First, when image information is sent and the operation of the image forming apparatus starts (S1), the movement direction and position of the current intermediate transfer belt 12 are calculated from the latest belt bias information (S2). For example, if the front edge detection sensor 38 is recently detected on the edge and time T5 has passed after separating from the edge detection sensor 38, calculation may be performed as follows. That is, since it takes moving time T3 (FIG. 3) for a bias width of 1 mm (the value obtained by subtracting the width of the intermediate transfer belt 12 from the interval of the edge detection sensors 38 and 39), the velocity V3 at which the intermediate transfer belt 12 moves backward from the front is, for example, 1/T3. If the moving velocity V3=1/T3 is obtained like this, the position after time T5 passes after the edge is detected can be calculated as T5/T3 mm from the front edge detection sensor 38.

In the present embodiment, data history of multiple times (for example five times) is stored for the front and back retention times T1 and T2 or moving times T3 and T4 from the latest backup data. The value taken as an average by tracing back to data of multiple times (five times) is used. The times T1 to T4 mentioned above are changed according to the condition under which the image forming apparatus is used. The retention time and the moving velocity at the time of the reversal of the bias direction of the intermediate transfer belt 12 are affected by the size of the coefficient of friction between the inside of the intermediate transfer belt 12 and the plural tensioning rollers and the change of the outer diameter of the tensioning roller. For example, as spattered toner is attached to the inside of the intermediate transfer belt 12 or the outer circumference of the tensioning roller, the friction coefficient or the outer diameter of the roller is changed.

In particular, when many image forming operations are performed in the image forming apparatus, scraped chips are generated by the friction between the inside of the intermediate transfer belt and the member in contact therewith (for example, the primary transfer roller), and the scraped chips are attached to the intermediate transfer belt or the tensioning roller to cause changes of the coefficient of friction or the outer diameter of the roller. Further, the same thing happens due to the toner spattered by airflow entering the inside of the intermediate transfer belt. Therefore, it is desirable that the retention time or the moving velocity be calculated from the latest information or the equivalent thereto.

Next, with respect to the photosensitive drum 1*a* of the image forming station Pa farthest upstream, T6 is used as the time from the timing at which an electrostatic latent image is formed by the exposure device 3*a* to the timing at which the toner image with the electrostatic latent image developed is conveyed to the position of the secondary transfer device 11. The variation in which the intermediate transfer belt 12 moves in the width direction crossing to the belt running direction in time T6 is estimated based on the information T1, T2, T3 and T4 stored in the backup RAM 54, that is, the detection results of the edge detection sensors 38 and 39 (S3).

Based on the variation of the intermediate transfer belt 12 estimated in step S3, the position in the width direction of the recording material S conveyed to the secondary transfer position T2 from the recording material cassette 13 is adjusted by the adjusting mechanism 70 (S4). The toner image on the intermediate transfer belt 12 is secondarily transferred by the secondary transfer device 11 for the recording material S and is conveyed toward the fixing device 9. Then the controller determines whether a next image forming job remains, and if so, carries out the next image forming operation, and completes the operation of the body if it determines that the job has been completed (S5).

Specifically, in the image forming apparatus of the present embodiment, the moving time T3 from the front to the back and, the moving time T4 from the back to the front, were about 15 sec, based on the average of five times in the intermediate transfer belt unit 200 in which there are fewer image forming operations. In the intermediate transfer belt unit 200 in which the image forming operation is performed for 50000 sheets of plain paper of A4 size, the times of T3 and T4 were shortened by about 10 sec. At the same time, there was a tendency of the difference between the velocity V3 of the bias from front to back and the velocity V4 from back to front, to increase. The front retention time T1 and the back retention time T2 were about 2 sec, based on the average of five times. If the bias velocities V3 and V4 become faster, the image gradient (margin gradient) in one sheet of printed material becomes a problem, so in the present embodiment, it was instructed that the intermediate transfer belt units be exchanged if the bias time T3 or T4 became 4 sec or less.

Further, in the present embodiment, the actuator 72 is a stepping motor, and one in which the drive pulse rotated 7.5° per pulse and the variation of the rod 73 changed 0.7 mm in a 360° rotation was used. That is, the position was controlled by a resolution of 1 pulse=14.5 μm.

By measuring the width of the left and right margins of 1000 sheets of printed material output after performing the above control on every image forming operation, it was possible to confirm that they were within the range of 2.5 mm±100 μm with respect to the margin center 2.5 mm. Compared with this, when control of the present embodiment was not performed, the printed material with a noticeable difference of the left and right margins of more than 2.5 mm±300 μm was output, and was only in the range of 2.5 mm±500 μm.

In the present embodiment mentioned above, the width direction variation of the intermediate transfer belt 12 is estimated by the edge detection sensors 38 and 39, and the position in the width direction of the recording material is controlled so as to match the toner image and the position of the recording material. Therefore, the position shift of the width direction between the toner image and the recording material can be reduced. As a result, it is possible to provide an image forming apparatus which outputs high-quality printed material in which the widths of the left and right margins of the image formed on the recording material are stabilized.

In addition, in the present embodiment, the value taken as an average by tracing back to the data of multiple times (five times) is used from the latest backup data for the retention time of the front and back T1 and T2 and the moving time T3 and T4. Therefore, it is possible to reduce the position shift of the width direction between the toner image and the recording material with a higher degree of precision. However, only data from the most recent time may be used to make the same estimation.

Further, a predetermined latent image forming timing at which the position aligning toner image is formed is set as a timing at which an electrostatic latent image is formed in the image forming station Pa farthest upstream. Because the image forming station Pa farthest upstream is farthest away from the secondary transfer device 11, the position shift is apt to be greatest. Therefore, as in the present embodiment, by controlling based on the timing at which the electrostatic latent image is formed in the image forming station Pa farthest upstream, it is possible to effectively reduce the position shift in the width direction between the toner image and the recording material.

However, the predetermined latent image forming timing, for example, may also be an average timing at which the latent image is formed at each image forming station. That is, the timing amounting to half of the time until the electrostatic latent image is formed at the lowermost stream image forming station Pd after the electrostatic latent image is formed at the image forming station Pa farthest upstream is set as a predetermined latent image forming timing. It is possible for the toner image not to be formed at this timing in practice, and in such cases, the apparatus is controlled under the assumption that the toner image is formed at this timing.

Second Embodiment

A second embodiment of the present invention will be described using FIGS. 8 and 9 with reference to FIGS. 1 to 3. Whereas in the first embodiment mentioned above, the width direction variation of the intermediate transfer belt 12 is estimated so as to control the position in the width direction of the recording material S, in the present embodiment the write timing of the electrostatic latent image of the main scanning direction (the width direction) is controlled by the exposure device 3 without changing the position of the recording material S. That is, the position in the width direction of the electrostatic latent image is controlled. As for the configuration of the body, it is the same as the first embodiment, so description of the identical portion of configuration is omitted, and the following description will be given with a focus on other portions.

Figure 8:
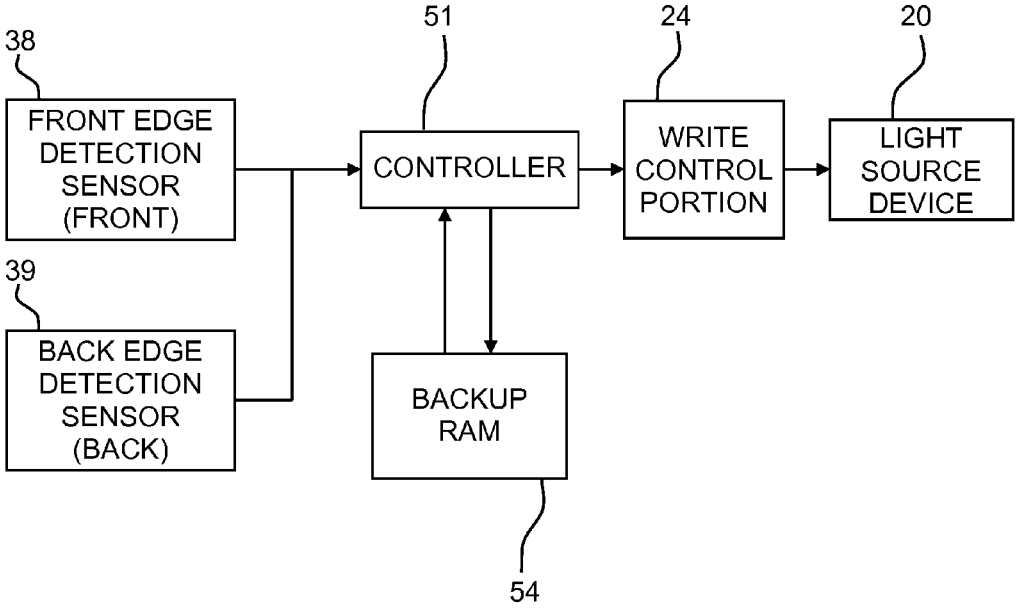
FIG. 8 is a block diagram of a control circuit that controls the write timing of the electrostatic latent image of a main scanning direction in a second embodiment of the present invention.
Figure 9:
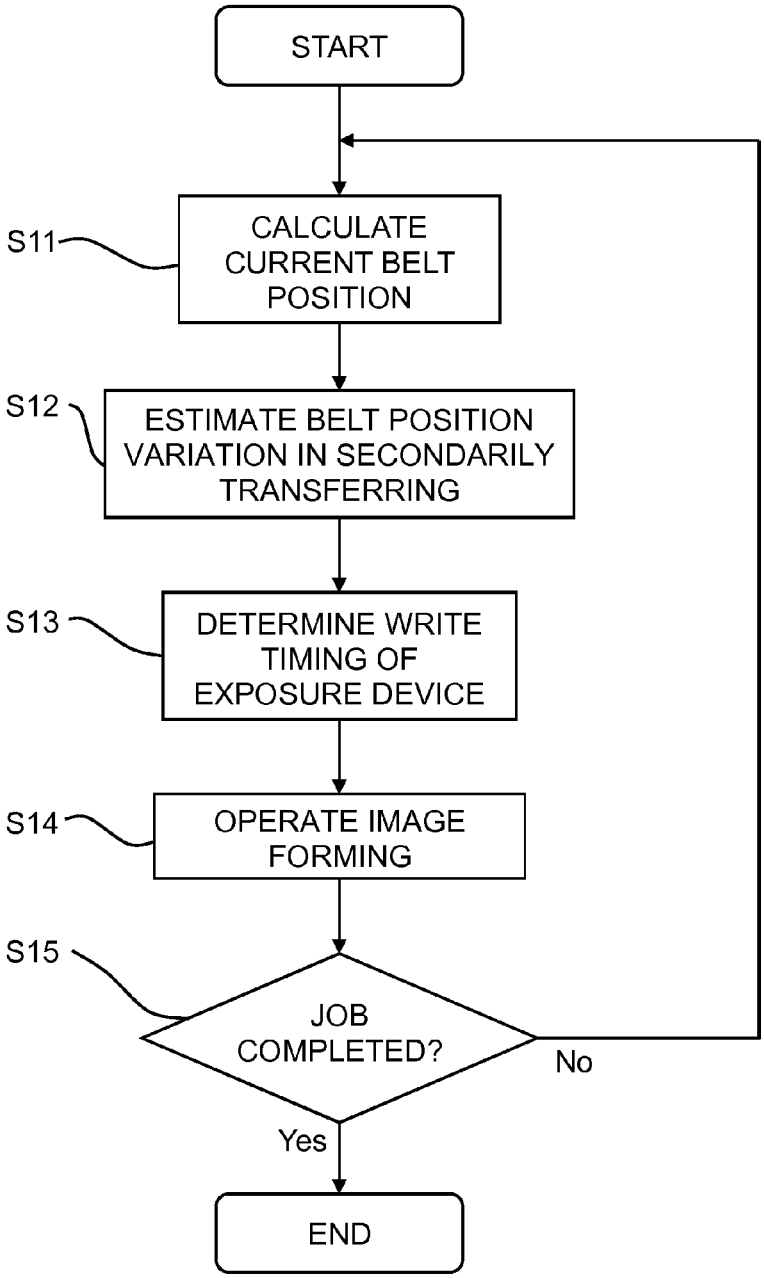
FIG. 9 is a flow chart for controlling the write timing of the electrostatic latent image in the second embodiment.

FIG. 8 is a block diagram of a control circuit which controls the write timing of the electrostatic latent image of the main scanning direction by the exposure device 3. The steering information of the intermediate transfer belt 12 is sent from the front and back edge detection sensors 38 and 39, so that history of multiple times is stored in the backup RAM 54. Subsequently, when an image forming job is started, data is read from the backup RAM 54 before the electrostatic latent image is written by the exposure device 3. With this data, the write timing of the electrostatic latent image of the main scanning direction by the light source device 20 of the exposure device 3 is determined by the controller 51, and control command is sent to the write control portion 24. Then, the light source device 20 is operated to perform the exposure for the photosensitive drum 1.

Meanwhile, the station that delays the write timing of the electrostatic latent image may be only the image forming station farthest upstream, or all image forming stations. The write timing of each station is determined by the relation with a predetermined latent image forming timing at which an aligning toner image is to be formed. For example, if a predetermined latent image forming timing is used as the timing at which an electrostatic latent image is formed at the image forming station Pa farthest upstream, the write timing of the electrostatic latent image of the image forming station farthest upstream is delayed depending on the width direction variation at the obtained intermediate transfer belt 12. In the case of delaying the write timing of the electrostatic latent image at all image forming stations, position control may be performed by calculating the width direction moving amount of the intermediate transfer belt 12 based on the write timing of the electrostatic latent image of the image forming station farthest upstream.

The write timing of the electrostatic latent image of the main scanning direction by the exposure device 3 in the present embodiment can be changed in units of, for example, 1/16 of a pixel, and since 1 pixel is 42 μm, position control can be performed with a resolution of 2.625 μm. On the conveying path of the recording material S, an abutting plate is installed on the position regulating board 71 (see FIG. 4) of the first embodiment, and a load, such as from abutting the recording material, is applied from the conveying roller 16. Thereby, it is possible to stabilize the position of the direction perpendicular to the conveying direction of the recording material.

Next, an example of control flow in which the positions in the width direction of the toner image and the recording material S are matched by delaying the write timing of the electrostatic latent image as mentioned above will be described using FIG. 9. First, when image information is sent, operation of the image forming apparatus is started, and the moving direction and position of the current belt are calculated from the latest belt steering information (S11).

Next, the time from the timing at which the electrostatic latent image is formed by the exposure device 3*a* for the photosensitive drum 1*a* of the image forming station Pa farthest upstream to the timing at which the toner image with the developed electrostatic latent image is conveyed to the position of the secondary transfer device 11 is defined as T6. The variation in which the intermediate transfer belt 12 moves in the width direction crossing to the running direction in time T6 is estimated based on the information T1, T2, T3 and T4 stored in the backup RAM 54, that is, the detection results of the edge detections sensors 38 and 39 (S12).

Next, based on the variation of the intermediate transfer belt 12 estimated in step S12, the electrostatic latent image write timing of the main scanning direction by the light source device 20 is determined (S13). A sequential image forming operation is started from the image forming station Pa farthest upstream, and image forming is performed on the recording material (S14). Subsequently, it is determined whether a next image forming job remains, and if so, the next image forming operation is performed, and the body operation is completed if it is determined that the job has been completed (S15).

By measuring the width of the left and right margins of 1000 sheets of printed material output after performing the above control on every image forming operation as in the first embodiment, it was possible to confirm that they were within the range of 2.5 mm±100 μm with respect to the margin center 2.5 mm. Compared with this, when control of the present embodiment was not performed, they were only in the range of 2.5 mm±500 μm.

In the case of the present embodiment, since the write timing of the electrostatic latent image by the exposure device 3 can be delayed, the adjusting mechanism 70 for the first embodiment is not necessary, so cost reduction can be achieved. Meanwhile, the adjusting mechanism 70 may be installed to control both the write timing of the electrostatic latent image and the position in the width direction of the recording material. As an exposure device, one in which a plurality of light sources (for example, LEDs) is arrayed in the main scanning direction may be used. In this case, by shifting the lighting position of the light source in the main scanning direction, the position in the width direction of the electrostatic latent image can be shifted. The structure and operation other than this are the same as the first embodiment mentioned above.

Third Embodiment

Figure 10:
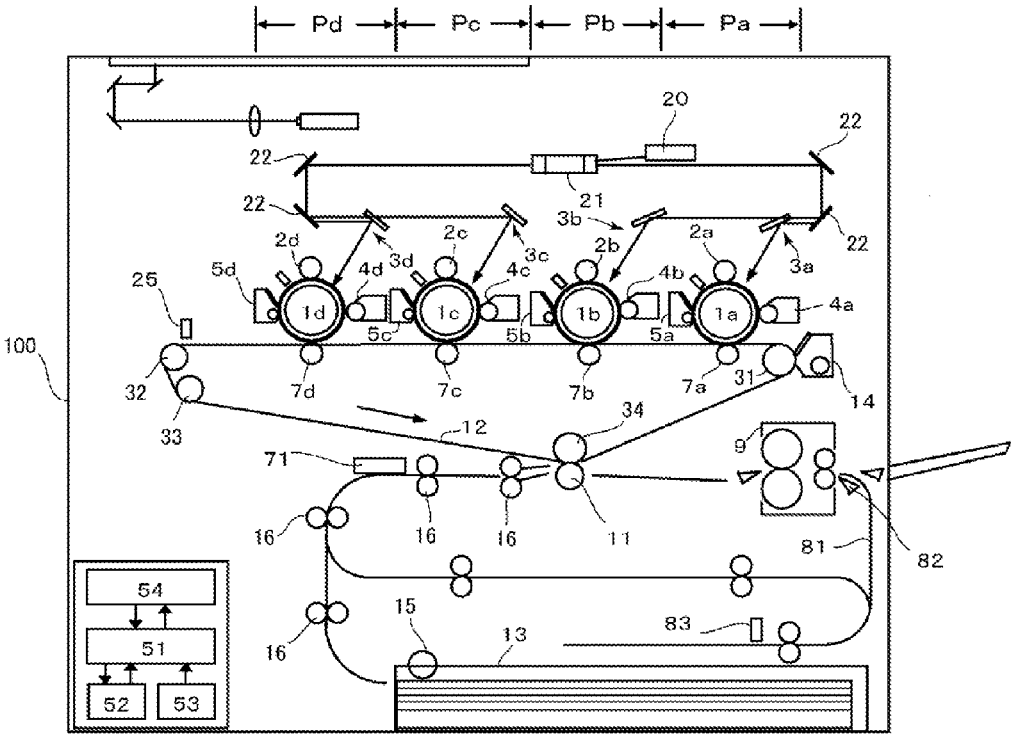
FIG. 10 is a view showing a schematic configuration of an image forming apparatus according to a third embodiment of the present invention.

A third embodiment of the present invention will be described using FIG. 10. Whereas in the first and second embodiments the configuration serves to control correction in single-side printing in which the image is formed on one side of the recording material S, in the present embodiment it is possible to control correction in duplex printing in which the images are formed on both sides of the recording material. The configuration of the body other than the sheet conveying path of both sides is the same as in the first embodiment, and so the same symbols will be attached to the same portions, description thereof will be omitted, and the following description will be given with a focus on other portions.

The image is formed on one side of the recording material S as described in the first embodiment, but in the present embodiment, operation of duplex printing in which the image is formed on both sides of the recording material S will be described. When duplex printing is performed, the image forming operation on side 1 of the recording material S is performed as in the first embodiment, and the toner image on side 1 is fixed on the recording material by the fixing device 9. The recording material S that has passed through the fixing device 9 is sent to a double-side conveying path 81 by a conveying path switching unit 82 provided further downstream in the recording material conveying direction than the fixing device 9 to reverse the recording material S, before it is conveyed again to the secondary transfer device 11 to have image forming performed on side 2.

Recording material position control on side 2 is performed as in the first embodiment. That is, the time from the timing at which the writing of the electrostatic latent image for the image information on side 2 is performed on the photosensitive drum 1*a* of the image forming station Pa to the timing at which the toner image with the developed electrostatic latent image is conveyed to the position of the secondary transfer device 11 is defined as T6'. Then, the variation of moving in the width direction crossing to the running direction of the intermediate transfer belt in time T6' is estimated based on the detection results of the edge detection sensors 38 and 39 as in the first embodiment. In the present embodiment, based on this estimation, the position of the position regulating board 71 is controlled and the position in the width direction of the recording material S is matched to the position of the toner image.

By performing control as above, the widths of the left and right margins of the images on side 1 and side 2 are stabilized and the left and right image positions on side 1 and side 2 can be matched also for duplex printing in which images are formed on both sides of the recording material. Meanwhile, in the present embodiment, the position of the recording material conveyed to the secondary transfer position T2 is controlled, but it is possible to obtain the same effect even if the write timing of the electrostatic latent image of the main scanning direction is controlled by the exposure device as shown in the second embodiment.

In the case of performing duplex printing on the recording material, moisture contained in the recording material on which image forming on side 1 is completed and which passes the fixing device will be reduced according to the kind of recording material. Because of this, the size of the recording material is changed sometimes. So, a sheet size sensor 83 is installed in the double-side conveying path 81 to detect the width of the direction crossing to the conveying direction of the recording material S. When there is a change in the sheet size, the multiplication factor of the main scanning direction of the electrostatic latent images formed on the photosensitive drums 1*a* to 1*d* by the exposure devices 3*a* to 3*d* is changed according to the change of the sheet size. Thus, the left and right image positions on side 1 and side 2 can be matched with a higher degree of precision.

Other Embodiments

In the embodiments mentioned above, a tandem-type structure in which a plurality of image forming stations is disposed side by side along an intermediate transfer belt is described. However, the present invention is not limited to this structure and can be applied to other structures.

For example, it can be applied to a so-called one-drum-type configuration in which a plurality of developers (developing units) is disposed in a rotor and respective colors are developed by sequentially shifting the developers facing the photosensitive drum by rotating the rotors. Also in this configuration, a predetermined latent image forming timing at which the position aligning toner image is formed can be the timing at which the electrostatic latent image developed by the initial developer is formed as in the respective embodiments mentioned above. Further, this predetermined latent image forming timing may be, for example, an average timing at which the electrostatic latent image developed by each developer is formed. However, in order to control with a higher degree of precision, it is preferable that a predetermined latent image forming timing be the timing for every electrostatic latent image developed by each developer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-229602, filed Oct. 19, 2011, which is hereby incorporated by reference herein in its entirety.

What is claimed is:

1. An image forming apparatus, comprising:

a movable photosensitive member;

an exposure unit configured to form a latent image on the photosensitive member at a predetermined exposure timing to correspond to a position of the latent image in a direction perpendicular to a moving direction of the photosensitive member;

a developing unit configured to form toner image from the latent image on the photosensitive member;

a movable endless intermediate transfer belt configured to have transferred to the endless intermediate belt the toner image from the photosensitive member;

a steering roller configured to stretch the intermediate transfer belt and configured to incline so as to move the intermediate transfer belt in a width direction;

a sensor configured to detect a position of the intermediate transfer belt in the width direction;

a controller configured to incline the steering roller based on a detection result of the sensor so as to maintain the position of the intermediate belt in the width direction within a predetermined range;

a transfer device configured to transfer the toner image on the intermediate transfer belt to a recording material at a transfer portion;

an output portion configured to output an estimated moving amount of the intermediate transfer belt, the estimated moving amount being a predicted value of moving amount of the intermediate transfer belt in the width direction which is determined based on a plurality of historical data of the sensor;

a moving device configured to move in the width direction a position of a recording material conveyed to the transfer portion; and an adjusting portion configured to adjust at least one of the position of a recording material in the width direction and the predetermined exposure timing so that a position of the toner image transferred onto a recording material with respect to the width direction is not at an incorrect position when the intermediate transfer belt moves in width direction within the predetermined range, based on information from the output portion.

2. The image forming apparatus of claim 1, wherein the moving device includes a position regulating member which regulates the position of the recording material in the width direction in contact with the end portion of the recording material in the width direction, and a moving member which moves the position regulating member in the width direction, and the adjusting portion adjusts the position of the recording material in the width direction supplied to the transfer portion by operating the moving member.

3. The image forming apparatus of claim 1, further having a plurality of other photosensitive members, wherein the photosensitive member is located most upstream in the moving direction of the intermediate transfer belt.

4. The image forming apparatus of claim 1, wherein the output portion outputs the estimated moving amount based on a plurality of historical data of a respective time intervals between a time at which moving direction of the intermediate transfer belt in the width position is switched.

* * * * *